US009595227B2

(12) United States Patent
Yang et al.

(10) Patent No.: US 9,595,227 B2
(45) Date of Patent: Mar. 14, 2017

(54) PIXEL CIRCUIT AND DRIVING METHOD THEREOF, ORGANIC LIGHT EMITTING DISPLAY PANEL AND DISPLAY APPARATUS

(71) Applicants: BOE Technology Group Co., Ltd., Beijing (CN); Beijing BOE Optoelectronics Technology Co., Ltd., Beijing (CN)

(72) Inventors: Shengji Yang, Beijing (CN); Xue Dong, Beijing (CN); Haisheng Wang, Beijing (CN); Yingming Liu, Beijing (CN); Jingbo Xu, Beijing (CN)

(73) Assignees: BOE Technology Group Co., Ltd., Beijing (CN); Beijing BOE Optoelectronics Technology Co., Ltd., Beijing (CN)

( * ) Notice: Subject to any disclaimer, the term of this patent is extended or adjusted under 35 U.S.C. 154(b) by 12 days.

(21) Appl. No.: 14/648,658

(22) PCT Filed: Oct. 15, 2014

(86) PCT No.: PCT/CN2014/088682

§ 371 (c)(1),
(2) Date: May 29, 2015

(87) PCT Pub. No.: WO2015/176474

PCT Pub. Date: Nov. 26, 2015

(65) Prior Publication Data

US 2016/0240139 A1 Aug. 18, 2016

(30) Foreign Application Priority Data

May 22, 2014 (CN) ..... 2014 1 0219026

(51) Int. Cl.
*G09G 3/32* (2016.01)

(52) U.S. Cl.
CPC ..... *G09G 3/3258* (2013.01); *G09G 3/32* (2013.01); *G09G 3/3233* (2013.01);
(Continued)

(58) Field of Classification Search
CPC ..... G05G 3/3258; G09G 3/3233; G09G 2310/0251; G09G 2320/0233; G09G 2320/0626
See application file for complete search history.

(56) References Cited

U.S. PATENT DOCUMENTS 6,421,033 B1 7/2002 Williams et al.
6,618,031 B1 9/2003 Bohn, Jr. et al.
(Continued)

FOREIGN PATENT DOCUMENTS

CN 102339586 A 2/2012
CN 102903333 A 1/2013
(Continued)

OTHER PUBLICATIONS

Jan. 16, 2015—International Search Report and Written Opinion Appn PCT/CN2014/088682 with English Tran.
(Continued)

*Primary Examiner* — Kwang-Su Yang
(74) *Attorney, Agent, or Firm* — Banner & Witcoff, Ltd.

(57) ABSTRACT

A pixel circuit and a driving method thereof, an organic light emitting display panel and a display apparatus, comprise: a light emitting device, a driving control module, a charging control module, a compensating control module and a light emitting control module; the light emitting control module controls the charging control module to charge driving control module under the control of the first scanning signal terminal and the light emitting signal terminal; the compensating control module transmits a data signal send from the data signal terminal to the first input terminal of the driving
(Continued)

control module through the charging control module under the control of the second scanning signal terminal; and the light emitting control module and the compensating control module control jointly the driving control module to drive the light emitting device to emit light under the control of the second scanning signal terminal and the light emitting signal terminal.

17 Claims, 7 Drawing Sheets

(52) U.S. Cl.
CPC ..... *G09G 2310/0251* (2013.01); *G09G 2320/0233* (2013.01); *G09G 2320/0626* (2013.01)

(56) References Cited

U.S. PATENT DOCUMENTS

| | | | | |
|---|---|---|---|---|
| 2008/0136753 | A1* | 6/2008 | Kim | G09G 3/3233 345/77 |
| 2009/0225013 | A1* | 9/2009 | Lee | G09G 3/3233 345/80 |
| 2012/0013597 | A1 | 1/2012 | Han | |
| 2013/0241916 | A1 | 9/2013 | Takasugi et al. | |
| 2013/0249875 | A1 | 9/2013 | Tseng et al. | |
| 2015/0193045 | A1 | 7/2015 | Zhou et al. | |

FOREIGN PATENT DOCUMENTS

| | | | |
|---|---|---|---|
| CN | 103000126 | A | 3/2013 |
| CN | 103198793 | A | 7/2013 |
| CN | 103383837 | A | 11/2013 |
| CN | 103474022 | A | 12/2013 |
| CN | 104021754 | B | 1/2016 |

OTHER PUBLICATIONS

Jan. 6, 2016—(CN)—Patent Certificate of Chinese Patent Application No. 201410219026.5 filed on May 22, 2014.

Dec. 10, 2015—(CN) Notice of Allowance Application 201410219026.5 with Eng Tran.

Sep. 6, 2015—(CN) First Office Action Application 201410219026.5 with Eng Tran.

* cited by examiner

PIXEL CIRCUIT AND DRIVING METHOD THEREOF, ORGANIC LIGHT EMITTING DISPLAY PANEL AND DISPLAY APPARATUS

The application is a U.S. National Phase Entry of International Application No. PCT/CN2014/088682 filed on Oct. 15, 2014, designating the United States of America and claiming priority to Chinese Patent Application No. 201410219026.5 filed on May 22, 2014. The present application claims priority to and the benefit of the above-identified applications and the above-identified applications are incorporated by reference herein in their entirety.

TECHNICAL FIELD

The present disclosure relates to a pixel circuit and driving method thereof, an organic light emitting display panel and a display apparatus.

BACKGROUND

An organic light emitting display (OLED) is one of hot topics in the field of flat panel display. Compared with a liquid crystal display, OLED has advantages of low power consumption, low production cost, self-luminescent, broad view angle and fast response speed and so on. At present, in the display field such as mobile phone, PDA and digital camera and the like, OLED has taken the place of the traditional LCD display screen. Unlike that LCD controls luminance by using a stable voltage, OLED is current-driven and a stable current is required to control light emitting. Due to manufacturing processes, device aging and so on, non-uniformity exists in a threshold voltage $V_{th}$ of a driving transistor of a pixel circuit, thereby resulting in that a change occurs in the current flowing through OLED of each pixel point such that display luminance is non-uniform, which influences display effect of the entire image.

SUMMARY

Given that, there provide in embodiments of the present disclosure a pixel circuit and a driving method thereof, an organic light emitting display panel and a display apparatus to raise luminance uniformity of images in the display area of the display apparatus.

Therefore, a pixel circuit provided in an embodiment of the present disclosure comprises: a light emitting device, a driving control module, a charging control module, a compensating control module and a light emitting control module, wherein, a first input terminal of the charging control module is connected to a first scanning signal terminal, a second input terminal thereof is connected to an output terminal of the driving control module and a first input terminal of the compensating control module a third input terminal thereof is connected to a first output terminal of the compensating control module, a first output terminal thereof is connected to a first input terminal of the driving control module, and a second output terminal thereof is connected to a first level signal terminal, a first input terminal of the light emitting control module is connected to a second level signal terminal, a second input terminal thereof is connected to a light emitting signal terminal, and an output terminal thereof is connected to a second input terminal of the driving control module, a second input terminal of the compensating control module is connected to a second scanning signal terminal, a third input terminal thereof is connected to a data signal terminal, and a second output terminal thereof is connected to the light emitting device, the light emitting control module controls the charging control module to charge the driving control module under a control of the first scanning signal terminal and the light emitting signal terminal, the compensating control module transmits a data signal sent from the data signal terminal to the first input terminal of the driving control module through the charging control module under a control of the second scanning signal terminal, and the light emitting control module and the compensating control module control jointly the driving control module to drive the light emitting device to emit light under a control of the second scanning signal terminal and the light emitting signal terminal.

In the pixel circuit provided in the embodiment of the present disclosure, a driving voltage for the driving control module to drive the light emitting device to emit light is only related to a data signal voltage input at the data signal terminal, but is unrelated to a threshold voltage in the driving control module, which can avoid the threshold voltage from influencing the light emitting device, i.e., upon using the same data signal to be applied to different pixel units, images having the same luminance can be obtained, thereby raising luminance uniformity of images in the display area of the display apparatus.

In a possible implementation, in the pixel circuit provided in the embodiment of the present disclosure, the driving control module specifically comprises a driving transistor, wherein a gate of the driving transistor is the first input terminal of the driving control module, a source thereof is the second input terminal of the driving control module, and a drain thereof is an output terminal of the driving control module.

In a possible implementation, in the pixel circuit provided in the embodiment of the present disclosure, the driving transistor is a P type transistor, a voltage of the first level signal terminal is a negative voltage or a zero voltage, and a voltage of the second level signal terminal is a positive voltage.

In a possible implementation, in the pixel circuit provided in the embodiment of the present disclosure, the charging control module comprises: a first switch transistor, a second switch transistor and a capacitor, wherein gates of the first switch transistor and the second switch transistor are connected to the first scanning signal terminal, a drain of the first switch transistor is connected to the first level signal terminal, and a source thereof is connected to a first terminal of the capacitor and the first output terminal of the compensating control module, and wherein a drain of the second switch transistor is connected to a second terminal of the capacitor and the gate of the driving transistor, and a source thereof is connected to the drain of the driving transistor.

In a possible implementation, in the pixel circuit provided in the embodiment of the present disclosure, the first switch transistor and the second switch transistor are N type transistors or P type transistors simultaneously.

In a possible implementation, in the pixel circuit provided in the embodiment of the present disclosure, the compensating control module comprises a third switch transistor and a fourth switch transistor, wherein gates of the third switch transistor and the fourth switch transistor are connected to the second scanning signal terminal, a source of the third switch transistor is connected to the data signal terminal, and a drain thereof is connected to the third input terminal of the charging control module, and wherein a source of the fourth switch transistor is connected to the drain of the driving transistor, a drain thereof is connected to one terminal of the light emitting device, and the other terminal of the light emitting device is connected to the first level signal terminal.

In a possible implementation, in the pixel circuit provided in the embodiment of the present disclosure, the third switch transistor and the fourth switch transistor are N type transistors or P type transistors simultaneously.

In a possible implementation, in the pixel circuit provided in the embodiment of the present disclosure, the light emitting control module comprises a fifth switch transistor, wherein a gate of the fifth switch transistor is connected to the light emitting signal terminal, a source thereof is connected to the second level signal terminal, and a drain thereof is connected to the source of the driving transistor.

In a possible implementation, in the pixel circuit provided in the embodiment of the present disclosure, the fifth switch transistor is and N type transistor or a P type transistor.

An organic light emitting display panel provided in an embodiment of the present disclosure comprises the pixel circuit provided in the embodiments of the present disclosure.

A display apparatus provided in an embodiment of the present disclosure comprises the organic light emitting display panel provided in the embodiments of the present disclosure.

DETAILED DESCRIPTION

Specific implementations of the pixel circuit, the organic light emitting display panel and the display apparatus provided in embodiments of the present disclosure will be described below in detail by combining with the accompanying figures.

Figure 1:
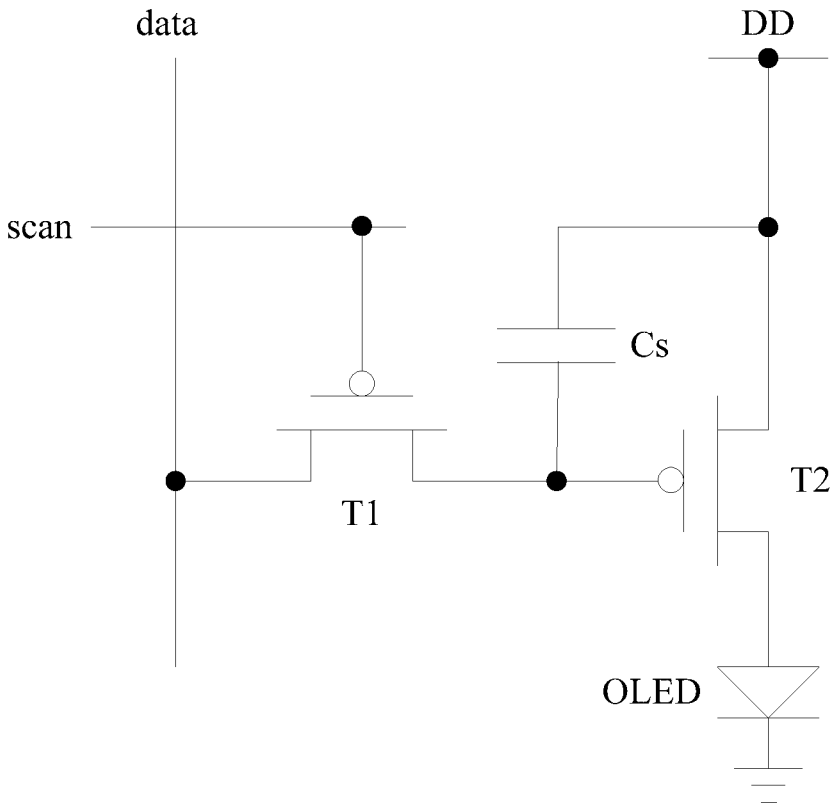
Fig. 1 (Prior Art)
FIG. 1 is a schematic diagram of a structure of a known 2T1C pixel circuit.

FIG. 1 shows schematically a structure of a known 2T1C pixel circuit. As shown in FIG. 1, the circuit is constituted of one driving transistor T2, one switch transistor T1 and one storage capacitor Cs. When a scanning line Scan selects one row, the scanning line Scan is input a low level signal, a P type switch transistor T1 is turned on, and a voltage of a data line Data is written into the storage capacitor Cs; after the row scanning is ended, the signal input to the scanning line Scan changes into a high level, the P type switch transistor T1 is turned off, and a gate voltage stored in the storage capacitor Cs makes the driving transistor T2 generate a current to drive OLED, so as to ensure OLED to emit light continuously within a frame. Herein, the saturation current formula of the driving transistor T2 is $I_{OLED}=K(V_{GS}-V_{th})2$. As described above, due to manufacturing processes and device aging, the threshold voltage $V_{th}$ of the driving transistor T2 would drift, which results in that the current flowing through each OLED changes with the threshold voltage $V_{th}$ of the driving transistor, thereby causing luminance nonuniformity of images.

Figure 2:
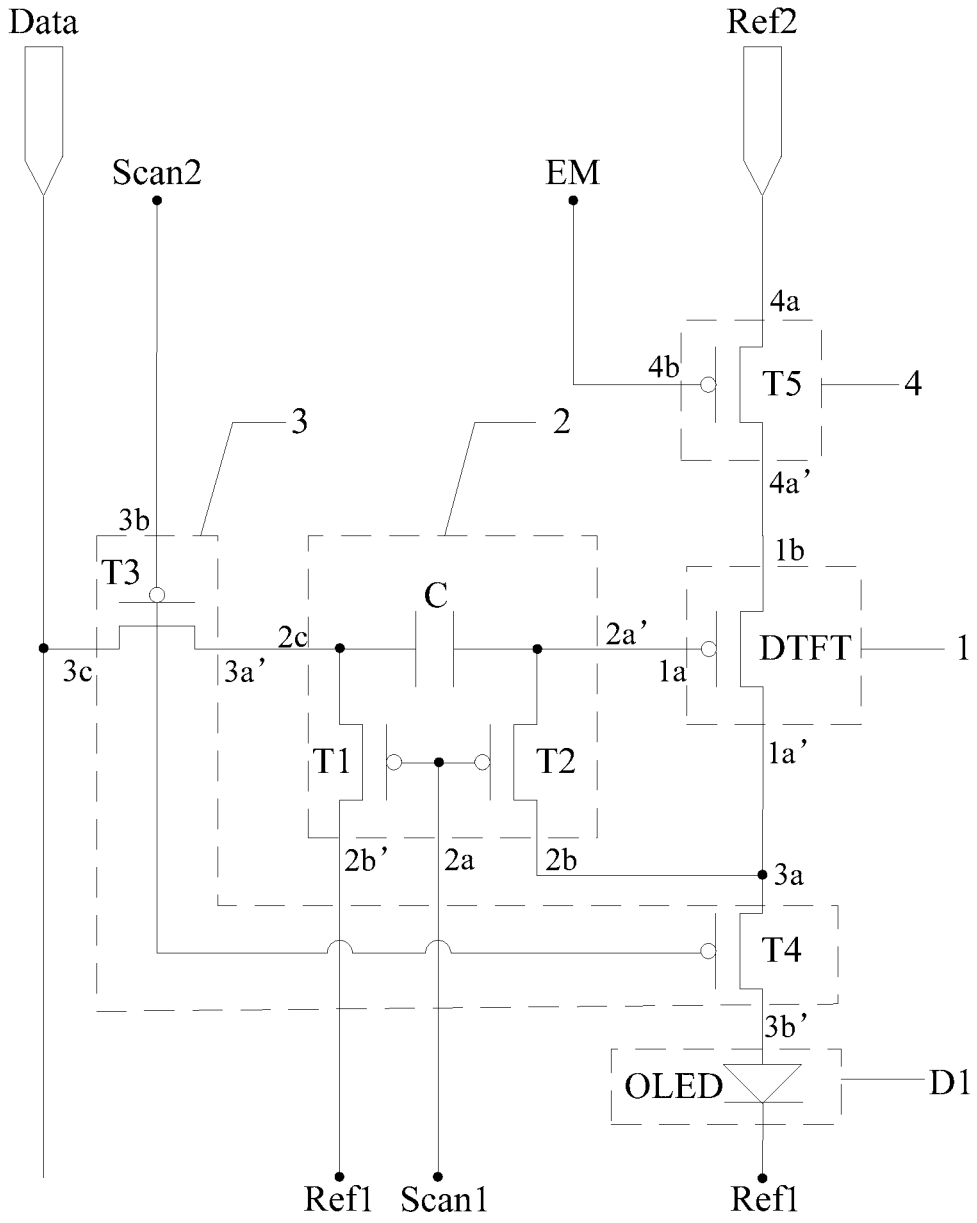
FIG. 2 is a schematic diagram of a structure of a pixel circuit provided in an embodiment of the present disclosure.

FIG. 2 shows schematically a structure of a pixel circuit of an embodiment of the present disclosure. As shown in FIG. 2, the pixel circuit comprises: a light emitting device D1, a driving control module 1, a charging control module 2, and a compensating control module 3 and a light emitting control module 4.

In the circuit as shown in FIG. 2, a first input terminal 2*a* of the charging control module 2 is connected to a first scanning signal terminal Scan1. A second input terminal 2*b* of the charging control module 2 is connected to an output terminal 1*a*' of the driving control module 1 and a first input terminal 3*a* of the compensating control module 3 respectively. A third input terminal 2*c* of the charging control module 2 is connected to a first output terminal 3*a*' of the compensating control module 3. A first output terminal 2*a*' of the charging control module 2 is connected to a first input terminal 1*a* of the driving control module 1. A second output terminal 2*b*' of the charging control module 2 is connected to a first level signal terminal Ref1.

A first input terminal 4*a* of the light emitting control module 4 is connected to a second level signal terminal Ref2. A second input terminal 4*b* of the light emitting control module 4 is connected to a light emitting signal terminal EM. An output terminal 4*a*' of the light emitting control module 4 is connected to a second input terminal 1*b* of the driving control module 1.

A second input terminal 3*b* of the compensating control module 3 is connected to a second scanning signal terminal Scan2. A third input terminal 3*c* of the compensating control module 3 is connected to a data signal terminal Data. A second output terminal 3*b*' of the compensating control module 3 is connected to the light emitting device D1.

The light emitting control module 4 controls the charging control module 2 to charge driving control module 1 under a control of the first scanning signal terminal Scan1 and the light emitting signal terminal EM. The compensating control module 3 transmits a data signal sent from the data signal terminal Data to the first input terminal 1*a* of the driving control module 1 through the charging control module 2 under the control of the second scanning signal terminal Scan2. The light emitting control module 4 and the compensating control module 3 control jointly the driving control module 1 to drive the light emitting device D1 to emit light under the control of the second scanning signal terminal Scan2 and the light emitting signal terminal EM.

As shown in FIG. 2, the driving control module 1 in the pixel circuit of the embodiment of the present disclosure can comprise a driving transistor DTFT. Herein, a gate of the driving transistor DTFT is the first input terminal 1*a* of the driving control module 1, a source thereof is the second input terminal 1*b* of the driving control module 1, and a drain thereof is the output terminal 1*a*' of the driving control module 1.

As an example, the light emitting device D1 in the pixel circuit of the embodiment of the present disclosure is an organic light emitting diode (OLED) in general. The light emitting device D1 realizes light emitting and displaying under the effect of the saturation current of the driving transistor DTFT.

Operating process of the pixel circuit of the present embodiment can be divided into following three phases:

A first phase is a charging phase. In this phase, the pixel circuit realizes a function of applying a voltage to the first input terminal 1*a* of the driving control module 1, i.e., the gate of the driving transistor DTFT. In this phase, the second scanning signal terminal Scan2 controls the compensating control module 3 to be in a turn-off state, the first scanning signal terminal Scan1 controls the charging control module 2 to be in a turn-on state, and the light emitting signal terminal EM controls the light emitting control module 4 to be in the turn-on state. The turned-on light emitting control module 4 connects the second level signal terminal Ref2 with the source of the driving transistor DTFT. The turned-on charging control module 2 connects the first level signal terminal Ref1 with the third input terminal 2*c* of the charging control module 2, and shorts the drain and gate of the driving transistor DTFT. Storage of the threshold voltage $V_{th}$ of the driving transistor DTFT is realized at the gate of the driving transistor DTFT.

A second phase is a compensating phase. In this phase, the pixel circuit realizes a function of compensating for and jumping of the voltage of the first input terminal 1*a* of the driving control module 1, i.e., the gate of the driving transistor DTFT. In this phase, the second scanning signal terminal Scan2 controls the compensating control module 3 to be in the turn-on state, the first scanning signal terminal Scan1 controls the charging control module 2 to be in the turn-off state, and the light emitting signal terminal EM controls the light emitting control module 4 to be in a turn-off state. The turned-on compensating control module 3 connects the data signal terminal Data with the third input terminal 2*c* of the charging control module 2, and applies the data signal of the data signal terminal Data to the gate of the driving transistor DTFT through the charging control module 2 to realize compensating for and jumping of the data signal at the gate of the driving transistor DTFT.

A third phase is a light emitting phase. In this phase, the pixel circuit realizes a function of driving the light emitting device D1 to emit light by the saturation current of the driving transistor DTFT. In this phase, the second scanning signal terminal Scan2 controls the compensating control module 3 to be in the turn-on state, the first scanning signal terminal Scan1 controls the charging control module 2 to be in the turn-off state, and the light emitting signal terminal EM controls the light emitting control module 4 to be in the turn-on state. The turned-on light emitting control module 4 connects the second level signal terminal Ref2 with the source of the driving transistor DTFT. The turned-on compensating control module 3 connects the drain of the driving transistor DTFT with the light emitting device D1 to drive the light emitting device D1 to emit light.

In the pixel circuit provided in the embodiment of the present disclosure, the driving voltage for the driving control module 1 to drive the light emitting device D1 to emit light is only related to a data signal voltage input at the data signal terminal Data, but is unrelated to a threshold voltage in the driving control module 1, which can avoid the threshold voltage from influencing the light emitting device D1, i.e., upon applying the same data signal to different pixel units, images having the same luminance can be obtained, thereby raising luminance uniformity of images in the display area of the display apparatus.

For example, in the pixel circuit provided in the embodiment of the present disclosure, the driving transistor DTFT that drives the light emitting device to emit light is a P type transistor in general. Since the threshold voltage $V_{th}$ of the P type transistor is a negative value, in order to ensure that the driving transistor DTFT can operate normally, the corresponding voltage of the first level signal terminal Ref1 is required to be a negative value or a zero voltage, and its function can be realized generally by adopting the existing VSS signal terminal; the voltage of the second level signal terminal Ref2 is required to be a positive voltage, and its function can be realized generally by adopting the existing VDD signal terminal. Below are descriptions by taking the voltage of the first level signal terminal Ref1 being zero and the voltage of the second level signal terminal Ref2 being a positive value as an example.

Exemplarily, as shown in FIG. 2, the charging control module 2 in the pixel circuit of the present embodiment can comprise a first switch transistor T1, a second switch transistor T2 and a capacitor C.

Gates of the first switch transistor T1 and the second switch transistor T2 are connected to the first scanning signal terminal Scan1 respectively.

A drain of the first switch transistor T1 is connected to the first level signal terminal Ref1, and a source thereof is connected to the first terminal of the capacitor C and the first output terminal 3*a*' of the compensating control module 3.

A drain of the second switch transistor T2 is connected to the second terminal of the capacitor and the gate of the driving transistor DTFT respectively, and a source thereof is connected to the drain of the driving transistor DTFT.

Alternatively, the first switch transistor T1 and the second switch transistor T2 can be N type transistors or P type transistors simultaneously, to which no limitation is made. In the case that the first switch transistor T1 and the second switch transistor T2 are N type transistors, when a signal of the first scanning signal terminal Scan1 is at a high level, the first switch transistor T1 and the second switch transistor T2 are in the turn-on state; in the case that the first switch transistor T1 and the second switch transistor T2 are P type transistors, when the signal of the first scanning signal terminal Scan1 is at a low level, the first switch transistor T1 and the second switch transistor T2 are in the turn-on state.

When the charging control module 2 in the pixel circuit of the present embodiment is constituted of the first switch transistor T1, the second switch transistor T2 and the capacitor C, its operating principle is as follows: in the charging phase, the first switch transistor T1 and the second switch transistor T2 are turned on; the first level signal terminal Ref1 and the first terminal of the capacitor C are turned on, that is, a potential at the first terminal of the capacitor C is 0; the second level signal terminal Ref2 charges the second terminal of the capacitor C through the light emitting control module 4→the driving transistor DTFT→the second switch transistor T2, until a potential at the second terminal of the capacitor C reaches $V_{ref2}-V_{th}$. In the compensating phase and light emitting phase, the first switch transistor T1 and the second switch transistor T2 are turned off.

As an example, as shown in FIG. 2, the compensating control module 3 in the pixel circuit provided in the embodiment of the present disclosure can comprise a third switch transistor T3 and a fourth switch transistor T4.

In FIG. 2, gate of the third transistor T3 and gate of the fourth switch transistor T4 are connected to the second scanning signal terminal Scan2 respectively.

A source of the third switch transistor T3 is connected to the data signal terminal Data, and a drain thereof is connected to the third input terminal 2*c* of the charging control module 2, that is, the drain of the third switch transistor T3 is connected to the drain of the first transistor T1 and the first terminal of the capacitor respectively.

A source of the fourth switch transistor T4 is connected to the drain of the driving transistor DTFT, a drain thereof is connected to one terminal of the light emitting device D1, and the other terminal of the light emitting device D1 is connected to the first level signal terminal Ref1.

For example, the third switch transistor T3 and the fourth switch transistor T4 can be N type transistors or P type transistors simultaneously, to which no limitation is made. In the case that the third switch transistor T3 and the fourth switch transistor T4 are N type transistors, when a signal of the second scanning signal terminal Scan2 is at the high level, the third switch transistor T3 and the fourth switch transistor T4 are in the turn-on state; in the case that the third switch transistor T3 and the fourth switch transistor T4 are P type transistor, when a signal of the second scanning signal terminal Scan2 is at the low level, the third switch transistor T3 and the fourth switch transistor T4 are in the turn-on state.

In the pixel circuit provided in the embodiment of the present disclosure, when the third switch transistor T3 and the fourth switch transistor T4 are taken as the specific structure of the compensating control circuit 3, its operating principle is as follows: in the charging phase, the third switch transistor T3 and the fourth switch transistor T4 are turned off. In the compensating phase, the third switch transistor T3 and the fourth switch transistor T4 are turned on, and the data signal terminal Data and the first terminal of the capacitor C are turned on. Now, the potential at the first terminal of the capacitor C is from $0 \rightarrow V_{data}$, i.e., jumping into a potential the same as the potential at the data signal terminal. According to the principle electricity conservation of the capacitor, the voltage of the second terminal of the capacitor C jumps correspondingly into $V_{ref2}-V_{th}+V_{data}$. In the light emitting phase, the third switch transistor T3 and the fourth switch transistor T4 are turned on, and a current signal of the second level signal terminal Ref2 drives the light emitting device D1 to emit light through the light emitting control module 4→the driving transistor DTFT→the fourth switch transistor T4. Herein, it can be obtained by the calculation of the saturation capacitance formula of the driving transistor DTFT that the operating current flowing into the light emitting device D1 is $I_{OLED}=K(V_{GS}-V_{th})^2=K[V_{ref2}-(V_{ref2}-V_{th}+V_{data})-V_{th}]^2-K(V_{data})^2$. It can be seen that the operating current $I_{OLED}$ of the light emitting device has already not been affected by the threshold voltage $V_{th}$ of the driving transistor, but is only related to the signal voltage $V_{data}$ input to the data signal terminal. Thus, the problem that the operating current $I_{OLED}$ of the light emitting device D1 is affected because of the threshold voltage $V_{th}$ drift caused by manufacturing process and long-time operation of the driving transistor DTFT is solved thoroughly, thereby ensuring the normal operation of the light emitting device D1.

As an example, as shown in FIG. 2, the light emitting control module 4 in the pixel circuit 4 provided in the embodiment of the present disclosure can comprise a fifth switch transistor 5.

In this case, a gate of the fifth switch transistor T5 is connected to the light emitting signal terminal EM, a source thereof is connected to the second level signal terminal Ref2, a drain thereof is connected to the source of the driving transistor DTFT.

For example, the fifth transistor T5 can be a N type transistor or a P type transistor, to which no limitation is made. In the case that the fifth switch transistor T5 is a N type transistor, when a signal of the light emitting signal terminal EM is at the high level, the fifth switch transistor T5 is in the turn-on state; in the case that the fifth switch transistor T5 is a P type transistor, when the signal of the light emitting signal terminal is at the low level, the fifth switch transistor T5 is in the turn-on state.

In the pixel circuit provided in the embodiment of the present disclosure, when the fifth switch transistor T5 is taken as the specific structure of the light emitting control module 4, its operating principle is: in the charging phase, the fifth switch transistor T5 is turned on; the second level signal terminal Ref2 and the source of the driving transistor DTFT are turned on, and the second level signal terminal Ref2 charges the second terminal of the capacitor C through the fifth switch transistor T5→the driving transistor DTFT→the second switch transistor T2 until the potential at the second terminal of the capacitor C reaches $V_{ref2}-V_{th}$. In the compensating phase, the fifth switch transistor T5 is turned off. In the light emitting phase, the fifth switch transistor T5 is turned on; the second level signal terminal Ref2 and the source of the driving transistor DTFT are turned on, and the current signal of the second level signal terminal Ref2 drives the light emitting device D1 to emit light through the fifth switch transistor T5→the driving transistor DTFT→the fourth switch transistor T4.

It needs to note that the driving transistor and switch transistors mentioned in the above embodiments of the present disclosure may be either thin film transistors (TFT) or metal oxide semiconductor transistors (MOS), to which no limitation is made. Sources and drains of these transistors can be exchanged with each other, and there is no distinction. The embodiment of the present disclosure is described by taking the driving transistor and switch transistors being thin film transistors as an example.

Moreover, all of the driving transistor and switch transistors mentioned in the pixel circuit provided in the embodiment of the present disclosure can adopt the design of the P type transistor, which can simplify the manufacturing process of the pixel circuit.

The operating principle of the pixel circuit is described below in detail by taking all of the driving transistor and switch transistors in the pixel circuit being P type transistors as an example.

Figure 3:
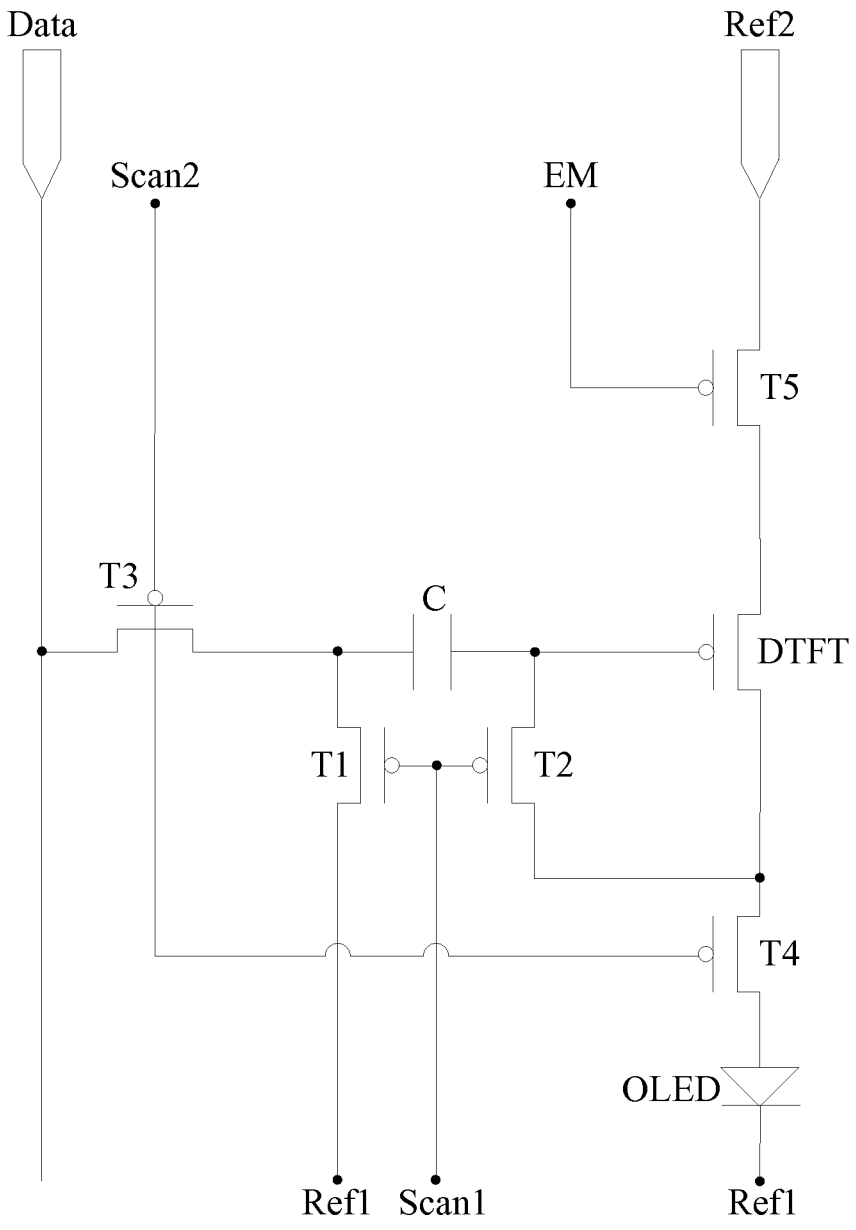
FIG. 3 is a schematic diagram of a specific structure of a pixel circuit provided in an embodiment of the present disclosure.
Figure 4:
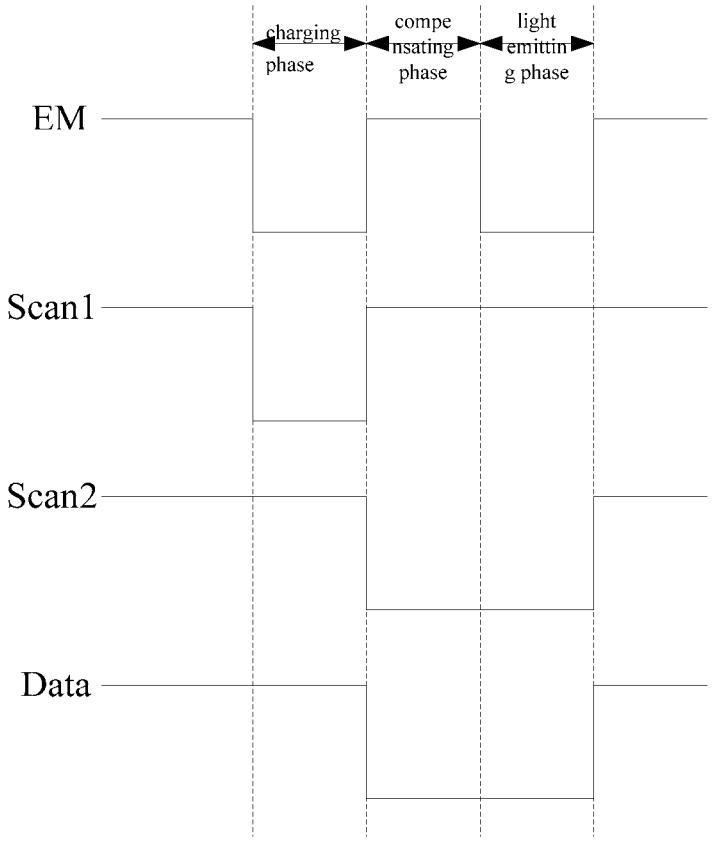
FIG. 4 is a circuit timing diagram of a pixel circuit provided in an embodiment of the present disclosure.
Figure 5:
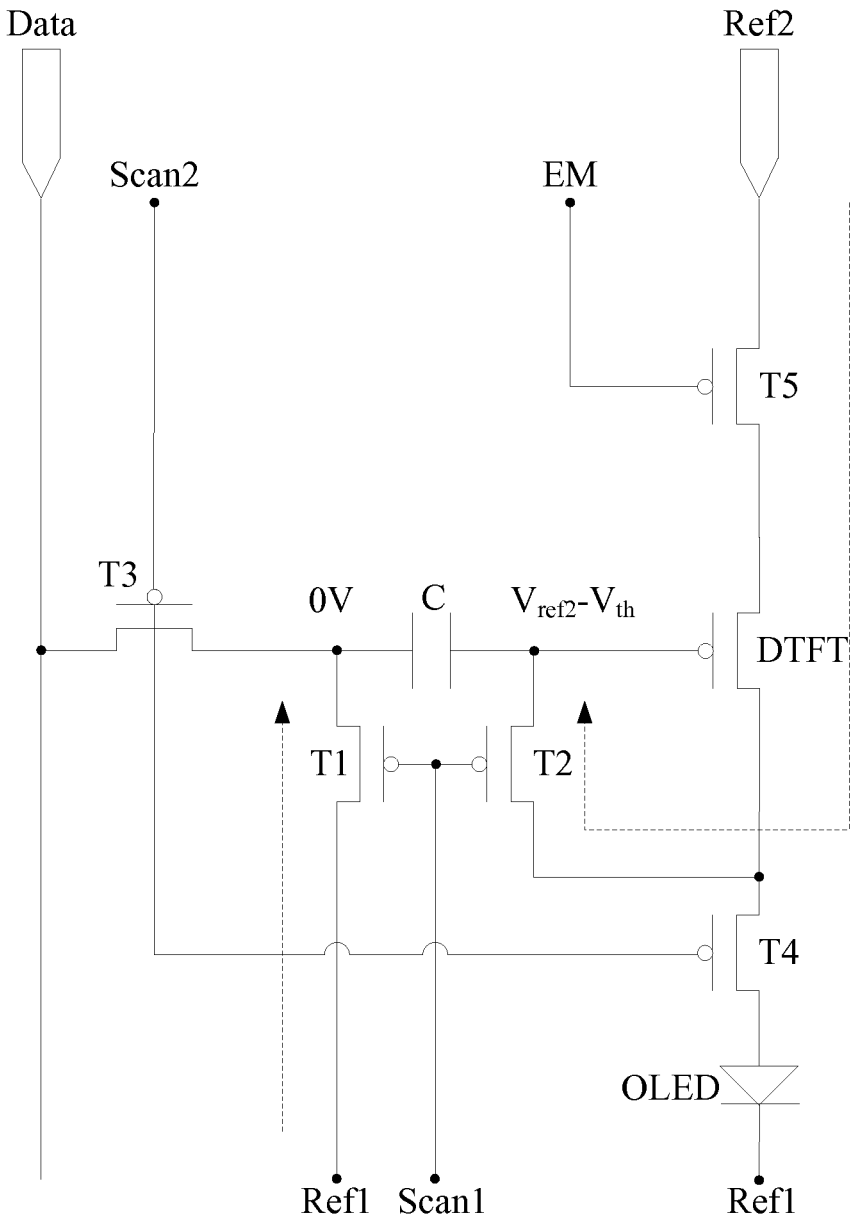
FIG. 5 is a schematic diagram of a pixel circuit provided in an embodiment of the present disclosure in a charging phase.
Figure 6:
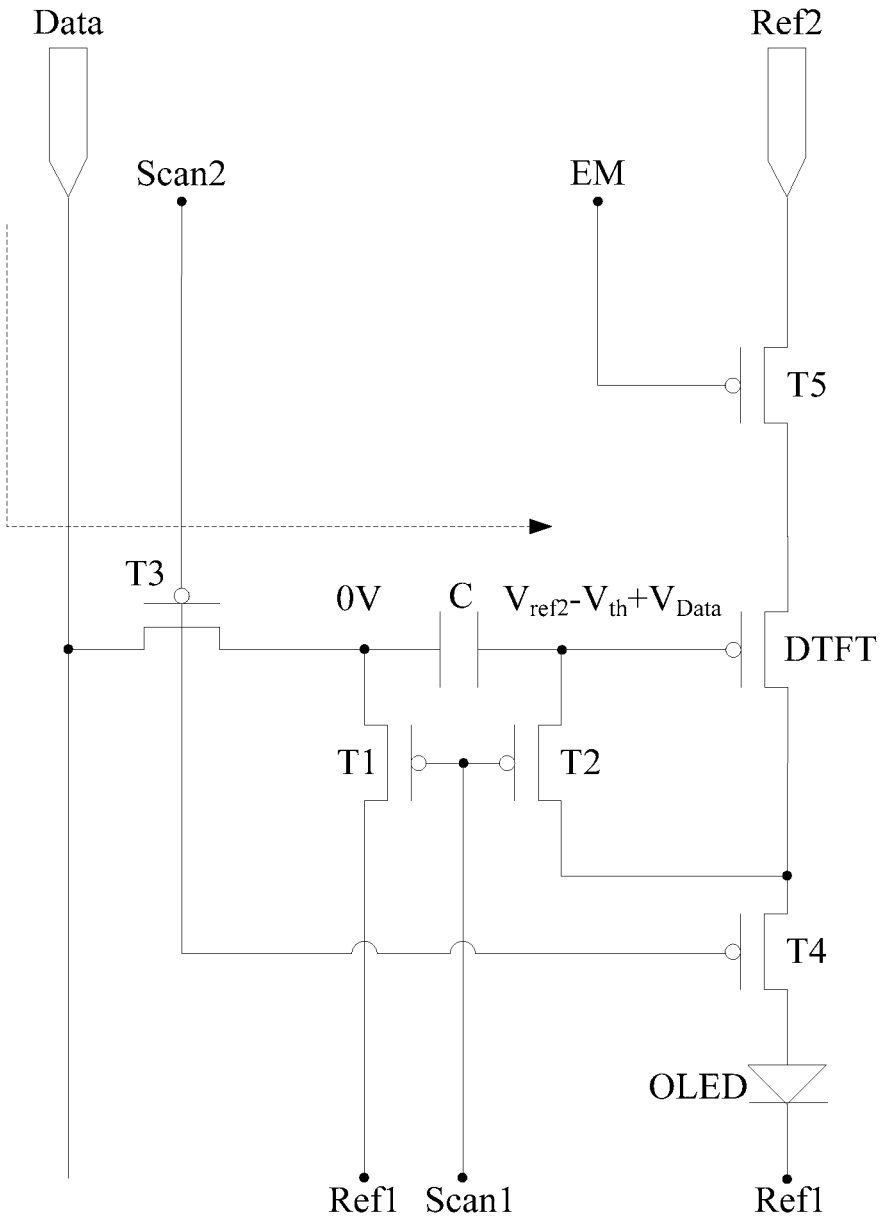
FIG. 6 is a schematic diagram of a pixel circuit provided in an embodiment of the present disclosure in a compensating phase.
Figure 7:
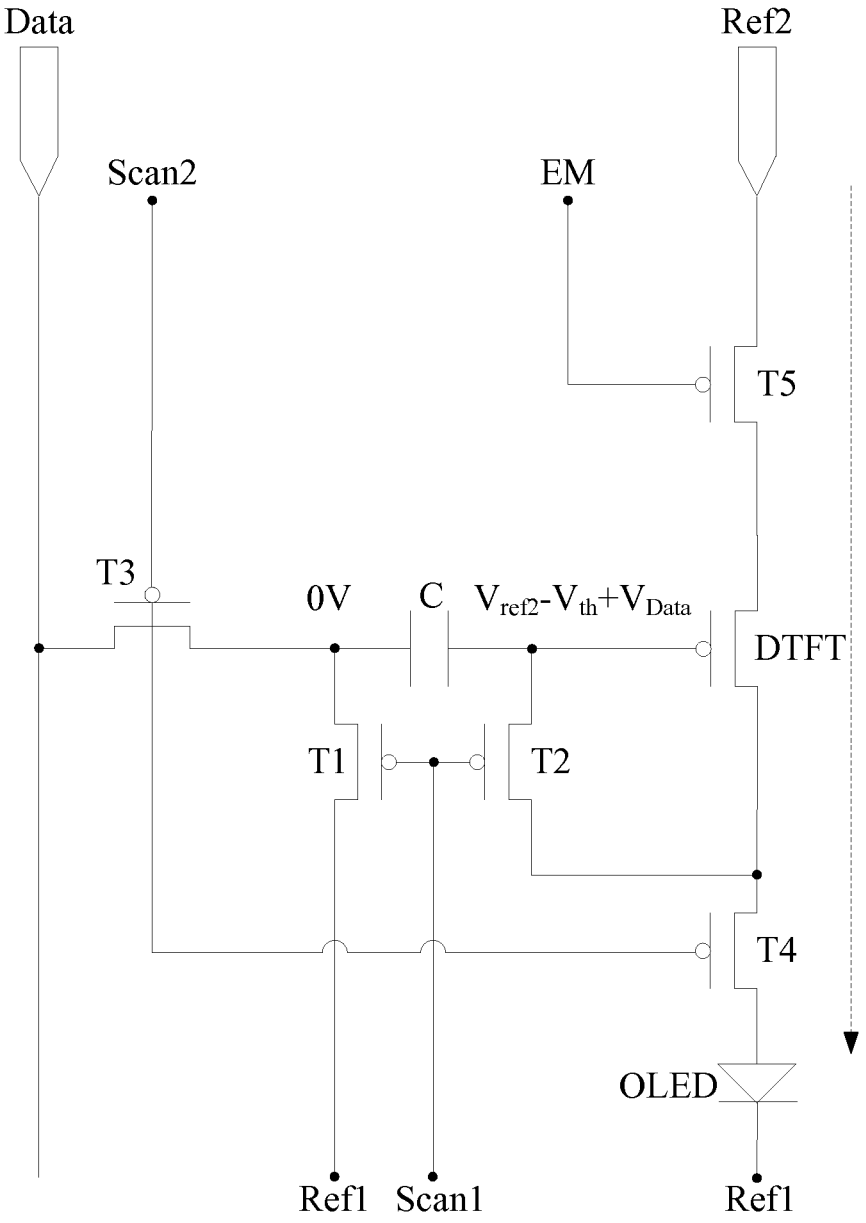
FIG. 7 is a schematic diagram of a pixel circuit provided in an embodiment of the present disclosure in a light emitting phase.

FIG. 3 is a schematic diagram of the circuit structure of the pixel circuit in the embodiment of the present disclosure. FIG. 4 is the corresponding timing diagram. FIG. 5 is a schematic diagram of the pixel circuit in the charging phase. FIG. 6 is a schematic diagram of the pixel circuit in the compensating phase. FIG. 7 is a schematic diagram of the pixel circuit in the light emitting phase.

The first phase is the charging phase. In this phase, as shown in FIG. 5, the pixel circuit realizes a function of applying voltage to the gate of the driving transistor DTFT. In this phase, as shown in FIG. 4, the second scanning signal terminal Scan2 is input a high level signal, and the third switch transistor T3 and the fourth switch transistor T4 are turned off; the first scanning signal terminal Scan1 and the light emitting signal terminal EM are input a low level signal, the first switch transistor T1, the second switch transistor T2 and the fifth switch transistor T5 are turned on, and the first level signal terminal Ref1 and the first terminal of the capacitor C are turned on through the first switch transistor T1, that is, the potential at the first terminal of the capacitor C changes into 0; the second level signal terminal Ref2 charges the second terminal of the capacitor C after flowing through the fifth switch transistor T5→the driving transistor DTFT→the second switch transistor T2 until the potential at the second terminal of the capacitor C reaches $V_{ref2}-V_{th}$, that is, the gate voltage of the driving transistor DTFT is $V_{ref2}-V_{th}$. In addition, since the fourth switch transistor T4 is turned off, the current of the driving transistor DTFT would not flow through the light emitting device D1, which indirectly reduces loss of service life of the light emitting device D1.

The second phase is the compensating phase. In this phase, as shown in FIG. 6, the pixel circuit realizes a function of compensating for and jumping the voltage of the gate of the driving transistor DTFT. In this phase, as shown in FIG. 4, the first scanning signal terminal Scan1 and the light emitting signal terminal EM are input the high level signal, and the first transistor T1, the second transistor T2 and the fifth transistor T5 are turned off; the second scanning signal terminal Scan2 is input the low level signal, the third transistor T3 and the fourth transistor T4 are turned on, and the data signal terminal Data and the first terminal of the capacitor C are turned on through the third switch transistor T3. Now, the potential at the first terminal of the capacitor C is from $0 \rightarrow V_{data}$, i.e., jumping into a potential the same as the potential at the data signal terminal. According to the principle electricity conservation of the capacitor, the voltage of the second terminal of the capacitor C jumps correspondingly into $V_{ref2}-V_{th}+V_{data}$, that is, the gate voltage of the driving transistor DTFT is $V_{ref2}-V_{th}+V_{data}$.

The third phase is the light emitting phase. In this phase, as shown in FIG. 7, the pixel circuit realizes a function of driving the light emitting device D1 to emit light by the saturation current of the driving transistor DTFT. In this phase, as shown in FIG. 4, the first scanning signal terminal Scan2 is input the high level signal, the first transistor T1 and the second transistor T2 are turned off; the second scanning signal terminal Scan2 and the light emitting signal terminal EM are input the low level signal, the third transistor T3 and the fourth transistor T4 are turned on, and a current signal of the second level signal terminal Ref2 drives the light emitting device D1 to emit light through the light emitting control module 4→the driving transistor DTFT→the fourth switch transistor T4. Herein, it can be obtained by the calculation of the saturation capacitance formula of the driving transistor DTFT that the operating current flowing into the light emitting device D1 is: $IOLED=K(V_{GS}-V_{th})^2=K[V_{ref2}-(V_{ref2}-V_{th}+V_{data})-V_{th}]^2-K(V_{data})^2$. It can be seen that the operating current $I_{OLED}$ of the light emitting device has not been affected by the threshold voltage $V_{th}$ of the driving transistor already, but is only related to the signal voltage $V_{data}$ input to the data signal terminal, which solves thoroughly the problem that the operating current $I_{OLED}$ of the light emitting device D1 is affected because of the threshold voltage $V_{th}$ drift caused by manufacturing process and long-time operation of the driving transistor DTFT, thereby ensuring the normal operation of the light emitting device D1.

Based on the same inventive concept, an embodiment of the present disclosure further provides an organic light emitting display panel comprising the pixel circuit provided in the embodiment of the present disclosure. The implementation of the organic light emitting display panel can refer to the implementation of the pixel circuit for the principle that the organic light emitting display panel solves the problem is similar to the pixel circuit described above, and thus details are not repeated herein.

Based on the same inventive concept, an embodiment of the present disclosure further provides a display apparatus comprising the organic light emitting display panel provided in the embodiment of the present disclosure. The display apparatus can be a display, a mobile phone, a television, a notebook, an all-in-one PC and the like. The other indispensable components of the display apparatus should be understood by those skilled in the art, and thus are not repeated herein, which should not be taken as a limitation to the present disclosure.

In the pixel circuit, the organic light emitting display panel and display apparatus provided in the embodiment of the present disclosure, the voltage for driving the light emitting device to emit light is only related to the voltage of the data signal, but is unrelated to the threshold voltage in the driving control sub-module, which can avoid the threshold voltage from influencing the light emitting device, i.e., upon using the same data signal to be applied to different pixel units, images having the same luminance can be obtained, thereby raising luminance uniformity of images in display area of the display apparatus.

Obviously, those skilled in the art can make various alternations and modifications to the present disclosure without departing from the spirit and scope of the present disclosure. As such, if these alternations and modification of the present disclosure belong to the scope of the claims of the present disclosure as well as their equivalents, then the present disclosure intends to comprise these alternations and modifications.

The present application claims the priority of a Chinese patent application No. 201410219026.5 filed on May 22, 2014. Herein, the content disclosed by the Chinese patent application is incorporated in full by reference as a part of the present disclosure.

What is claimed is:

1. A pixel circuit, comprising: a light emitting device, a driving control module, a charging control module, a compensating control module and a light emitting control module, wherein a first input terminal of the charging control module is connected to a first scanning signal terminal, a second input terminal thereof is connected to an output terminal of the driving control module and a first input terminal of the compensating control module, a third input terminal thereof is connected to a first output terminal of the compensating control module, a first output terminal thereof is connected to a first input terminal of the driving control module, and a second output terminal thereof is connected to a first level signal terminal, a first input terminal of the light emitting control module is connected to a second level signal terminal, a second input terminal thereof is connected to a light emitting signal terminal, and an output terminal thereof is connected to a second input terminal of the driving control module, a second input terminal of the compensating control module is connected to a second scanning signal terminal, a third input terminal thereof is connected to a data signal terminal, and a second output terminal thereof is connected to the light emitting device, the light emitting control module controls the charging control module to charge the driving control module under a control of the first scanning signal terminal and the light emitting signal terminal, the compensating control module transmits a data signal sent from the data signal terminal to the first input terminal of the driving control module through the charging control module under a control of the second scanning signal terminal, and the light emitting control module and the compensating control module control jointly the driving control module to drive the light emitting device to emit light under a control of the second scanning signal terminal and the light emitting signal terminal, and the charging control module comprises a first switch transistor, a second switch transistor and a capacitor, wherein a gate of the first switch transistor and a gate of the second switch transistor are connected to the first scanning signal terminal, wherein a drain of the first switch transistor is connected to the first level signal terminal, and a source thereof is connected to a first terminal of the capacitor and the first output terminal of the compensating control module, and wherein a drain of the second switch transistor is connected to a second terminal of the capacitor and the first input terminal of the driving control module, and a source thereof is connected to the output terminal of the driving control module.

2. The pixel circuit according to claim 1, wherein the driving control module comprises a driving transistor, and wherein a gate of the driving transistor is the first input terminal of the driving control module, a source thereof is the second input terminal of the driving control module, and a drain thereof is the output terminal of the driving control module.

3. The pixel circuit according to claim 2, wherein the driving transistor is a P type transistor, a voltage of the first level signal terminal is a negative voltage or a zero voltage, and a voltage of the second level signal terminal is a positive voltage.

4. The pixel circuit according to claim 2, wherein the compensating control module comprises a third switch transistor and a fourth switch transistor, and wherein a gate of the third switch transistor and a gate of the fourth switch transistor are connected to the second scanning signal terminal, a source of the third switch transistor is connected to the data signal terminal, and a drain thereof is connected to the third input terminal of the charging control module, and a source of the fourth switch transistor is connected to the drain of the driving transistor, a drain thereof is connected to one terminal of the light emitting device, and the other terminal of the light emitting device is connected to the first level signal terminal.

5. The pixel circuit according to claim 4, wherein the third switch transistor and the fourth switch transistor are N type transistors or P type transistors simultaneously.

6. The pixel circuit according to claim 2, wherein the light emitting control module comprises a fifth switch transistor, and wherein a gate of the fifth switch transistor is connected to the light emitting signal terminal, a source thereof is connected to the second level signal terminal, and a drain thereof is connected to the source of the driving transistor.

7. The pixel circuit according to claim 6, wherein the fifth switch transistor is an N type transistor or a P type transistor.

8. The pixel circuit according to claim 1, wherein the first switch transistor and the second switch transistor are N type transistors or P type transistors simultaneously.

9. An organic light emitting display panel, comprising the pixel circuit according to claim 1.

10. A display apparatus, comprising the organic light emitting display panel according to claim 9.

11. The display apparatus according to claim 10, wherein the driving control module comprises a driving transistor, and wherein a gate of the driving transistor is the first input terminal of the driving control module, a source thereof is the second input terminal of the driving control module, and a drain thereof is an output terminal of the driving control module.

12. The display apparatus according to claim 11, wherein the driving transistor is a P type transistor, a voltage of the first level signal terminal is a negative voltage or a zero voltage, and a voltage of the second level signal terminal is a positive voltage.

13. The display apparatus according to claim 11, wherein the compensating control module comprises a third switch transistor and a fourth switch transistor, and wherein a gate of the third switch transistor and a gate of the fourth switch transistor are connected to the second scanning signal terminal, a source of the third switch transistor is connected to the data signal terminal, and a drain thereof is connected to the third input terminal of the charging control module, and a source of the fourth switch transistor is connected to the drain of the driving transistor, a drain thereof is connected to one terminal of the light emitting device, and the other terminal of the light emitting device is connected to the first level signal terminal.

14. The display apparatus according to claim 13, wherein the third switch transistor and the fourth switch transistor are N type transistors or P type transistors simultaneously.

15. The display apparatus according to claim 11, wherein the light emitting control module comprises a fifth switch transistor, and wherein a gate of the fifth switch transistor is connected to the light emitting signal terminal, a source thereof is connected to the second level signal terminal, and a drain thereof is connected to the source of the driving transistor.

16. The display apparatus according to claim 15, wherein the fifth switch transistor is an N type transistor or a P type transistor.

17. The display apparatus according to claim 10, wherein the first switch transistor and the second switch transistor are N type transistors or P type transistors simultaneously.

* * * * *